US006294728B1

(12) United States Patent
Wagner et al.

(10) Patent No.: US 6,294,728 B1
(45) **Date of Patent: *Sep. 25, 2001**

(54) CABLE WITH EXTERNAL CONDUCTOR OF SEVERAL ELEMENTS

(75) Inventors: Dieter Wagner, Merkers; Rainer Fleischhauer, Vacha, both of (DE)

(73) Assignee: Alcatel, Paris (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/104,264

(22) Filed: Jun. 24, 1998

(30) Foreign Application Priority Data

Jul. 24, 1997 (DE) ..... 197 31 792

(51) Int. Cl.[7] ..... H01B 11/18
(52) U.S. Cl. ..... 174/28; 174/36; 174/106 R
(58) Field of Search ..... 174/28, 36, 106 R, 174/108, 107, 113 C, 131 A, 113 AS, 102 R; 333/243

(56) References Cited

U.S. PATENT DOCUMENTS 3,639,674 * 2/1972 Stier ..... 174/36
4,157,452 * 6/1979 Pignataro et al. ..... 174/36
4,847,448 * 7/1989 Sato ..... 174/36 X
4,920,234 * 4/1990 Lemke ..... 174/36
5,171,938 * 12/1992 Katsumata et al. ..... 174/36
5,739,471 * 4/1998 Burisch ..... 174/102 R

FOREIGN PATENT DOCUMENTS 2 353 121 A 12/1977 (FR) .
2 735 606 A 12/1996 (FR) .

* cited by examiner

*Primary Examiner*—Chau N. Nguyen
(74) *Attorney, Agent, or Firm*—Ware, Fressola, Van der Sluys & Adolphson LLP

(57) ABSTRACT

A cable is proposed, particularly a coaxial cable, with an internal conductor (1), an insulation (4) which encloses the internal conductor (1), an external conductor encompassing several elements (2) extending essentially in the longitudinal direction of the cable and resting on the insulation (4), and with a cladding layer (3) which rests on the elements (2) of the external conductor and on the insulation and encloses same, where the cross section of the surface (6) of the insulation (4) vertical to the longitudinal direction of the cable is a polygon, and the cladding layer (3) rests on the corners (7) of the polygon.

18 Claims, 1 Drawing Sheet

CABLE WITH EXTERNAL CONDUCTOR OF SEVERAL ELEMENTS

BACKGROUND OF THE INVENTION

1. Technical Field

The invention concerns a cable, particularly a coaxial cable, with an internal conductor, an insulation which encloses the internal conductor, and an external conductor which encompasses several long elements.

2. Description of the Prior Art

Many cables comprise one or several internal conductors, an insulation which encloses the internal conductor, and an external conductor placed over it which most often forms an electrical shield. Electrical coaxial cables e.g., such as are used for antenna cables or data cables have such a construction, for instance for networking computers. An external conductor often comprises long individual elements which preferably have a nearly circular cross section, especially wires, strands or optical fibers. The elements that rest on an insulation can form a single or several independent external conductors, and essentially extend in the longitudinal direction of the cable, with a possible winding around the cable axis, or a corrugation to equalize the length. The outside of the external conductor in turn is surrounded by a cladding layer, which jointly encloses its elements and the insulation and rests against both of them. In the simplest of cases the cable jacket is the cladding layer. Especially in coaxial cables, the usual construction has a metal foil applied as the cladding layer over external conductor wires, which together form the shielding of the internal conductor or conductors.

If stiff plastic insulations are used, there is always the danger of the external conductor elements shifting during the production of the cable or its handling, particularly when the cable is bent. If the elements of the external conductor are the shield wires of a coaxial cable, the shielding can undergo considerable impairment if the shield wires of the cable are shifted to the inside of a bend. When soft insulations are used, into which the elements can penetrate, the limitation of the possible insulation materials is a disadvantage. In addition, the production requires the elements to be accurately aligned in the intended position in the cable before the cladding layer is applied. Finally it can be imagined to provide grooves in the insulation and to deposit the elements therein. However, this is also expensive and requires a high degree of production accuracy.

SUMMARY OF THE INVENTION

Starting therefrom, the object of the invention is the development of a cable that can be produced in a simple manner, in which the elements of the external conductor are affixed around the cable axis independently of the mechanical characteristics of the insulation in regard to shifting.

The idea of the invention is to secure the external conductor on the periphery of the insulation by shaping it in conjunction with the cladding layer. To that end the outline of the insulation's cross section with respect to the vertical cable axis has the shape of a polygon. The elements of the external conductor are located in the area of the polygon sides, while the cladding layer is supported by the corners of the polygon and the outside of the elements. In this way the position of the external conductor elements is fixed on the insulation, which particularly prevents the cladding layer from shifting over the corners of the polygon. Suitable elements are for example wires or strands, perhaps made of copper, or optical fibers which can also be routed between electrical shield wires. To also be able to affix in the specified manner such external elements of the conductor which are stranded around the insulation, the sides and the corners of the polygon, namely the flat external surfaces and the edges of the insulation can extend helically around the cable axis.

Polygons with about 4 to 20, preferably 6 to 10 corners are useful as a function of the diameters of insulation and the elements. A small number of corners allows a particularly good attachment of the elements to the respective lateral surface of the polygon. But a larger number of corners allows to achieve a better approximation to a round cross section, which is preferred with a coaxial cable e.g. for reasons of field symmetry and handling. In addition to a polygon with flat sides, concave bulging or wavy insulation surfaces are possible to improve the attachment of the elements and possibly provide space for receiving elements with a larger diameter.

It is useful if the cladding layer is a tape or a foil which is preferably placed longitudinally in the cable and around the insulation and the elements. Adjacent edges of the cladding layer are preferably welded to abut or overlap each other. This makes it possible to provide a water-tight closure of the inner cladding layer against moisture penetrating into the cable jacket.

The configuration of the cable inside the polygon is mostly unrestricted within the framework of the invention. It is particularly possible to use different materials for the insulation, for instance solid or foamed plastics. A multilayer insulation is also possible, for example a plastic with a final foil or conductive layer placed on its surface. The cable can also contain one or several internal conductors which can either be electrical or also optical conductors.

The advantage of the proposed cable is in the secure attachment of the external conductor to the periphery of the insulation. In that case the attachment can be achieved in a simple manner, independently of the insulation material, by installing the cladding layer over the external conductor and the insulation. This precludes any shifting of the external conductor elements, for instance where the cable is bent. The shielding of coaxial cables can especially be improved in this manner. The defined arrangement of the external conductors is advantageous for connecting cables to each other or to interface units.

In an advantageous configuration of the invention both the cladding layer and several external conductors are electrically conductive and make electrical contact with each other. In that case it is useful if the cladding layer is a metal foil, for instance a steel or aluminum foil, or a two or more layered metal-plastic composite foil. In this way the cladding layer and the elements of the external conductor jointly form the shielding of the internal conductor, as is usual for example with a coaxial antenna cable or a data cable. However, in contrast to cables known from the state of the art, the wires or strands of the external conductor are fixed to prevent their shifting over/on the periphery of the insulation.

If the cladding layer is a tape that is introduced into the cable and laid around the insulation, production can be simplified if its adjacent edges overlap each other. Preferably this is a tape extending in the longitudinal direction of the cable, while its edges run parallel to the cable axis and overlap each other. In the case where a metal-plastic composite foil is the cladding layer, it is useful if both surfaces of the foil are electrically conductive in order to provide a reciprocal electrical contact in the overlap area, and thereby good shielding. It can be envisioned to cement or weld the overlapping edges.

In order to improve the attachment of the external conductor, the cladding layer is preferably attached to the insulation in the area of the polygon corners. To that end cementing or welding between the cladding layer and the insulation is proposed, which is easy to carry out. This effectively prevents an element of the external conductor from shifting over a corner of the polygon.

Especially if the external conductor forms a shield, possibly together with the cladding layer, the uniform arrangement of its elements on the surface of the insulation is advantageous. In that case it is useful if the number of elements per surface unit is the same on each side of the polygon. Furthermore a symmetrical cylinder structure of the cable with respect to its axis is an advantage as a rule. A uniform polygon as the cross section of the insulation represents an optimum approximation.

If the maximum distance of the polygon's outside from the imaginary circumcircle passing through its corner points corresponds to the diameter of the elements, the cross section of the cladding layer that is normal to the cable axis is nearly circular, since it rests both on the corners of the polygon as well as on the elements. Small deviations are possible, especially if several elements of the external conductors run along a lateral surface of the polygon. It is also possible for the diameters of adjacent elements that extend along a lateral surface to be different, so that an optimum approximation to an annular structure can be obtained in the cladding layer resting above them.

For the purpose of longitudinal equalization, for instance in cable bends, tensile strains or temperature differences, it is possible for the elements to have a corrugation normal to the cable axis.

DETAILED DESCRIPTION OF THE INVENTION

Figure 1:
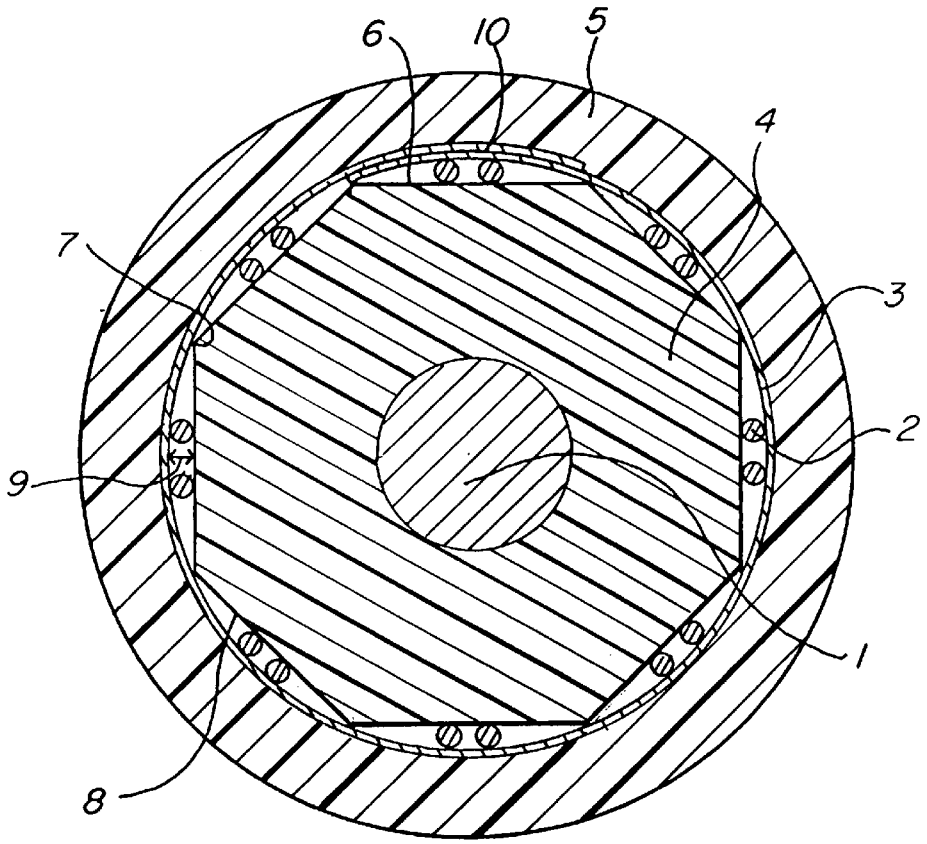
FIG. 1 is a cross-sectional view normal to the longitudinal axis of a coaxial cable according to the invention.
Figure 2:
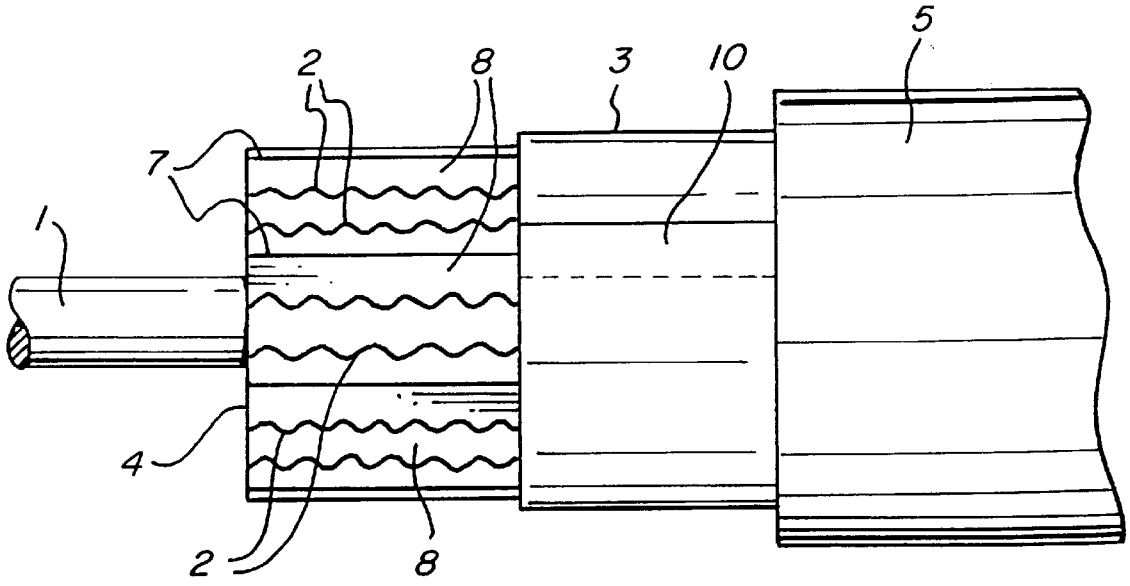
FIG. 2 is a side elevational view of a coaxial cable according to the invention with parts broken away to show internal structure.

Referring to FIGS. 1 and 2, the coaxial cable encompasses one or several internal conductors 1, an external conductor formed of several elements 2 and a cladding layer 3, as well as insulation 4 which is located between them, for instance a solid or a foamed plastic. On the outside the cable is closed off by a jacket 5. Wires can be used as the elements 2; a metal-plastic-metal composite foil is suitable as the cladding layer.

The cross section of the surface 6 of the insulation 4, vertical to the longitudinal direction of the cable, has the shape of a polygon, such as a regular polygon, for example an octagon. The cladding layer 3 and the insulation 4 are bonded or cemented to each other. This precludes any shifting of the individual elements 2 of the external conductor between different sides 8 of the surface 6.

To achieve a good approximation of the shape of the cladding layer 3, and thereby of the external conductor, to a cylindrical symmetry with the cable axis, it is necessary for the position of the cladding layer 3 to coincide approximately with an imaginary circumcircle of the polygon as extending through its corners 7. A good approximation can be achieved by allowing the maximum distance 9 between the sides 8 of the polygon and its imaginary circumcircle to be approximately equal to the diameter of the elements 2. In the example, the position of the cladding layer 3 coincides with the imaginary circumcircle within the framework of the accuracy of the drawing. However small deviations can be envisioned, particularly in the case of two or more elements 2 on each side 8.

An overlap 10 of the edges of the cladding layer 3 in the longitudinal direction of the cable simplifies the cable production. In that case a waterproof closure of the cable interior against moisture can be obtained by welding the overlap 10.

The result therefore is a coaxial cable with uniform distribution of the external conductor wires around the periphery, which are also fixed in their position when the cable is bent, thus improving the shielding effect and the ability to produce the cable.

What is claimed is:

1. Coaxial cable comprising:

(a) an internal conductor;

(b) an insulation which encloses the internal conductor and has a periphery which defines a polygon having a plurality of corners and sides;

(c) a metallic cladding layer surrounding the insulation, the cladding layer resting on the corners of the polygon and defining spaces between the sides of the polygon and the cladding layer; and (d) several long elements extending essentially longitudinally in the cable and situated in the spaces between the sides of the polygon and the cladding layer.

2. Cable as claimed in claim 1, wherein the elements and the cladding layer are electrically conductive and make electrical contact with each other.

3. Cable as claimed in claim 2, wherein the cladding layer is a metal foil.

4. Cable as claimed in claim 2, wherein the cladding layer is a metal-plastic composite foil.

5. Cable as claimed in claim 1, wherein adjacent edges of the cladding layer overlap each other.

6. Cable as claimed in claim 1, wherein the cladding layer is affixed to the insulation.

7. Cable as claimed in claim 6, wherein the cladding layer is adhesively bonded to the insulation.

8. Cable as claimed in claim 1, wherein the cladding layer is bonded to the insulation.

9. Cable as claimed in claim 1, wherein an equal number of the elements are located on each side of the polygon.

10. Cable as claimed in claim 1, wherein the polygon is a regular polygon.

11. Cable as claimed in claim 1, wherein the elements have a diameter and the maximum perpendicular distance of the sides of the polygon from the cladding layer corresponds to the diameter of the elements.

12. Cable as claimed in claim 1, wherein the elements have a corrugation normal to a longitudinal axis of the cable.

13. Cable as claimed in claim 1, wherein the cladding layer and the elements form shielding for the internal conductor.

14. Cable as claimed in claim 1, wherein the elements are fixedly located on each side of the polygon to prevent shifting thereon.

15. Cable as claimed in claim 1, further including a jacket surrounding the cladding layer.

16. Cable as claimed in claim 1, wherein each individual one of the several long elements extend essentially longitudinally in a single one of the spaces without extending into any of the other spaces.

17. Cable as claimed in claim 16, wherein all of the spaces have at lease one of the several long elements therein.

18. Cable as claimed in claim 1, wherein all of the spaces have at least an individual one of the several long elements therein.

* * * * *

UNITED STATES PATENT AND TRADEMARK OFFICE

CERTIFICATE OF CORRECTION

PATENT NO. : 6,294,728 B1
DATED : September 25, 2001
INVENTOR(S) : Dieter Wagner and Rainer Fleischhauer It is certified that error appears in the above-identified patent and that said Letters Patent is hereby corrected as shown below:

Column 6,
Line 4, "lease" should be -- least --.

Signed and Sealed this

Nineteenth Day of March, 2002

*Attest:*

*Attesting Officer*

JAMES E. ROGAN
*Director of the United States Patent and Trademark Office*